US008873990B2

(12) United States Patent
Taishi et al.

(10) Patent No.: US 8,873,990 B2
(45) Date of Patent: Oct. 28, 2014

(54) TONER DENSITY SENSOR AND IMAGE FORMING APPARATUS

(71) Applicant: OMRON Corporation, Kyoto (JP)

(72) Inventors: Yoshitaka Taishi, Ritto (JP); Hajime Kawai, Kyoto (JP)

(73) Assignee: OMRON Corporation, Kyoto (JP)

( * ) Notice: Subject to any disclaimer, the term of this patent is extended or adjusted under 35 U.S.C. 154(b) by 158 days.

(21) Appl. No.: 13/681,881

(22) Filed: Nov. 20, 2012

(65) Prior Publication Data

US 2013/0243466 A1 Sep. 19, 2013

(30) Foreign Application Priority Data

Mar. 15, 2012 (JP) ..... 2012-059045

(51) Int. Cl.
*G03G 15/00* (2006.01)
*G03G 15/10* (2006.01)
*G03G 15/08* (2006.01)

(52) U.S. Cl.
CPC ..... *G03G 15/5025* (2013.01); *G03G 15/5054* (2013.01); *G03G 15/0862* (2013.01)
USPC ..... 399/74; 399/64

(58) Field of Classification Search
USPC ..... 399/74, 64
See application file for complete search history.

(56) References Cited

U.S. PATENT DOCUMENTS 7,655,936 B2 * 2/2010 Sawayama et al. ..... 250/559.4
2004/0251435 A1 * 12/2004 Sawayama et al. ..... 250/559.16

FOREIGN PATENT DOCUMENTS

JP 2005-091252 A 4/2005

* cited by examiner

*Primary Examiner* — Walter L Lindsay, Jr.
*Assistant Examiner* — Rodney Bonnette
(74) *Attorney, Agent, or Firm* — Nutter McClennen & Fish LLP; John J. Penny, Jr.

(57) ABSTRACT

A toner density sensor comprising: a light emitting element that emits light; a light receiving element that receives reflected light emitted from the light emitting part and reflected at a detection target; a light path for passage of emitted and reflected light formed along the front surface of a printed substrate on which the light emitting element and the light receiving element are surface-mounted; and a diaphragm unit that is formed at and partially narrows this light path, wherein the diaphragm unit is divided into two portions, a diaphragm unit upper-portion and a diaphragm unit lower-portion, and these are disposed in an upper case covering the front surface of the printed substrate and in a lower case covering the rear surface of the printed substrate. In the printed substrate, a through hole is formed for protrusion of the diaphragm unit lower portion from the rear surface to the front surface.

12 Claims, 9 Drawing Sheets

11 --- TONER DENSITY SENSOR
12 --- LIGHT EMITTING ELEMENT
13,14 --- LIGHT RECEIVING ELEMENT
15 --- PRINTED SUBSTRATE
17 --- UPPER CASE
18 --- LOWER CASE
21 --- IRRADIATION PATH
22, 23 --- LIGHT RECEIVING PATH
25, 26 --- DIAPHRAGM UNIT
25a, 26a --- UPPER-SIDE DIAPHRAGM UNIT
25b, 26b --- LOWER-SIDE DIAPHRAGM UNIT
30 --- PROTRUSION
31 --- THROUGH HOLE

11 --- TONER DENSITY SENSOR
15 --- PRINTED SUBSTRATE
17 --- UPPER CASE
18 --- LOWER CASE

11 --- TONER DENSITY SENSOR
12 --- LIGHT EMITTING ELEMENT
13, 14 --- LIGHT RECEIVING ELEMENT
15 --- PRINTED SUBSTRATE
17 --- UPPER CASE
21 --- IRRADIATION PATH
22, 23 --- LIGHT RECEIVING PATH
25, 26 --- DIAPHRAGM UNIT
56 --- TRANSFER BELT

11 --- TONER DENSITY SENSOR
51 --- IMAGE FORMING APPARATUS
56 --- TRANSFER BELT

11 --- TONER DENSITY SENSOR
12 --- LIGHT EMITTING ELEMENT
13,14 --- LIGHT RECEIVING ELEMENT
15 --- PRINTED SUBSTRATE
17 --- UPPER CASE
18 --- LOWER CASE
21 --- IRRADIATION PATH
22, 23 --- LIGHT RECEIVING PATH
25, 26 --- DIAPHRAGM UNIT
25a, 26a --- UPPER-SIDE DIAPHRAGM UNIT
25b, 26b --- LOWER-SIDE DIAPHRAGM UNIT
30 --- PROTRUSION
31 --- THROUGH HOLE

11 --- TONER DENSITY SENSOR
12 --- LIGHT EMITTING ELEMENT
13, 14 --- LIGHT RECEIVING ELEMENT
15 --- PRINTED SUBSTRATE
17 --- UPPER CASE
18 --- LOWER CASE
21 --- IRRADIATION PATH
22, 23 --- LIGHT RECEIVING PATH
25, 26 --- DIAPHRAGM UNIT
25a, 26a --- UPPER-SIDE DIAPHRAGM UNIT
25b, 26b --- LOWER-SIDE DIAPHRAGM UNIT
30 --- PROTRUSION
31 --- THROUGH HOLE

11 --- TONER DENSITY SENSOR
12 --- LIGHT EMITTING ELEMENT
13, 14 --- LIGHT RECEIVING ELEMENT
15 --- PRINTED SUBSTRATE
17 --- UPPER CASE
18 --- LOWER CASE
21 --- IRRADIATION PATH
22, 23 --- LIGHT RECEIVING PATH
25,26 --- DIAPHRAGM UNIT
25a, 25d, 26a --- UPPER-SIDE DIAPHRAGM UNIT
25b, 25c, 26b--- LOWER-SIDE DIAPHRAGM UNIT
30 -- PROTRUSION
31 -- THROUGH HOLE

11 --- TONER DENSITY SENSOR
15 --- PRINTED SUBSTRATE
17 --- UPPER CASE
18 --- LOWER CASE
26 --- DIAPHRAGM UNIT
26a --- UPPER-SIDE DIAPHRAGM UNIT
26b --- LOWER-SIDE DIAPHRAGM UNIT
30 --- PROTRUSION
31 --- THROUGH HOLE
32 --- FIT HOLE
33 --- FIT PROTRUSION

TONER DENSITY SENSOR AND IMAGE FORMING APPARATUS

TECHNICAL FIELD

The present invention relates to a toner density sensor that is used for an image forming apparatus such as a copying machine, a printer, and a facsimile machine, and particularly relates to such a toner density sensor as to make a balance between suppression of variations in detection accuracy and realization of size reduction.

RELATED ART

A toner density sensor is an important component for obtaining optimum image quality in an image forming apparatus. As shown in FIG. 8, a toner density sensor 101 includes a light emitting part 102 that applies light, light receiving parts 103, 104 that receive light having been applied from the light emitting part 102 and reflected at a detection target, and an amplification unit that amplifies detection voltages of the light receiving parts 103, 104. When an image forming apparatus mounted with the toner density sensor 101 is an intermediate transfer type apparatus where a toner image primarily transferred to an intermediate belt is secondarily transferred to a paper sheet, light reflected at the toner image on the intermediate belt is detected by the light receiving parts 103, 104. A density of toner adhering to the intermediate transfer belt is detected based on a photocurrent (detection voltage) generated in the light receiving part, 103, 104, and a necessary correction is optically or electrically performed based on the detection result.

The light emitting part and the light receiving parts of the toner density sensor 101, which act as thus described, are each made up of an element such as a phototransistor, and surface-mounted on a printed substrate 105. The elements (referring to the light emitting part 102 and the light receiving parts 103, 104 herein and below) mounted on the front surface of the substrate 105 are covered by a black case 106 that is attached to the front surface of the substrate 105. In this case 106, a light blocking wall that blocks light is formed as appropriate, thereby to form a light path having an irradiation path 107 that allows passage of light applied from the light emitting part 102 onto the front surface of the substrate 105 and light receiving paths 108, 109 that allow passage of reflected light reflected at the detection target. The light path is designed in a portion under light, and the width, length and shape of the light path portion in the case 106 is designed based on a desired irradiated range and sensed range.

However, since the elements as the light emitting part 102 and the light receiving parts 103, 104 are surface-mounted on the substrate 105 as described above, there has been a problem in that mounted positions of the elements may be displaced. That is, although the element is mounted by being placed on a solder-applied land with an automatic mounting device and then soldered, the element may move at the time of melting the applied solder. This causes displacement of the element mounted position, as indicated by virtual lines in FIG. 8.

Such displacement of the mounted position occurs irregularly in each mounting, and occurs with respect to each element even on the same substrate 105. The state of occurrence of the displacement differs in each toner density sensor 101. For this reason, variations in detection accuracy (detection characteristics) have occurred among each toner density sensor 101.

In order to suppress such variations in detection accuracy, there has been proposed formation of a light path in a diaphragm unit 110 that narrows the light path, as disclosed in FIGS. 9A and 9B of Japanese Unexamined Patent Publication No. 2005-91252. That is, as shown in FIG. 9A, the diaphragm unit 110 is formed in the vicinity of the element in the irradiation path 107 or the light receiving path 108 or 109 extending in front of the element. In FIG. 9A, numeral 113 denotes a lens.

This diaphragm unit 110 is formed in the case 106 that is attached to the front surface of the substrate 105, and formed in a shape where an opening is partially made in a partition-like portion provided so as to block the light path. When the diaphragm unit 110 is formed such that only the portion corresponding to the center in a height direction of the element allows passage of light, as indicated by an arrow shown in FIG. 9A, the diaphragm unit 110 can mainly receive light entering from a portion X that corresponds to the center in the height direction of the element, and can block light entering from the outer side of the portion that corresponds to the center in the height direction of the element. Although the direction of the arrow in FIG. 9 shows only the light receiving side, the same applies to the light emitting side.

Since the diaphragm unit 110 stops irradiated light and received light and a position to stop the light is constant in the relation between the substrate 105 and the case 106, variations in detection accuracy can be suppressed even when the position of the element is displaced.

However, since the element as the light emitting part or the light receiving part has a size as minute in the order of several millimeters, it is difficult to manufacture the case 106 formed with a hole 111 only corresponding to the center in the height direction of the element, as shown in FIG. 9A.

Furthermore, as shown in FIG. 9B, the smaller the light emitting part 102 and the light receiving parts 103, 104 are made to perform size reduction as a big advantage in using the surface mounted type light emitting part 102 and light receiving parts 103, 104, the more the center P portion of the hole 111 to be made in the diaphragm unit 110 descends, and the closer the center P portion gets to the front surface of the substrate 105. Hence a height H of a lower-side portion 112 of the hole 111 shown in FIG. 9A decreases. For this reason, in the case of using small elements, the case 106 cannot be formed.

Further, in consideration of such conditions, when the case 106 having a shape without the lower-side portion 112 of the hole 111 in the diaphragm unit 110 is used, light incident from obliquely above on the lower-side portion 112 of the diaphragm unit 110 is reflected at the front surface of the substrate 105, and the detection accuracy thus cannot be ensured.

Moreover, in the toner density sensor described in Unexamined Japanese Patent Publication No. 2005-91252, the diaphragm unit 110 is formed only in the vicinity of the element in the irradiation path 107 or the light receiving path 108 or 109 extending in front of the element. There have thus been cases where light cannot be sufficiently blocked by the diaphragm unit 110.

SUMMARY

Thereat, it is a main object of the present invention to make a balance between suppression of variations in detection accuracy and realization of size reduction.

In accordance with one aspect of the present invention, a toner density sensor includes: a light emitting part that emits light in order to detect a toner density; a light receiving part that receives reflected light having been applied from the light emitting part and reflected at a detection target; a light path formed along the front surface of a substrate on which the light emitting part and the light receiving part are surface-mounted, the light path having an irradiation path that allows passage of light applied from the light emitting part, and a light receiving path that allows passage of the reflected light; and a diaphragm unit that is formed at the light path and partially narrows the light path, wherein an upper case that covers the light emitting part and the light receiving part and forms a diaphragm unit upper portion that is one of upper and lower portions of the diaphragm unit, is provided on the front surface of the substrate, a lower case that is coupled with the upper case to hold the substrate therebetween is provided on the rear surface of the substrate, a protrusion part with its top end provided with a diaphragm unit lower portion that is one of upper and lower portions of the diaphragm unit, is formed in the lower case, and a through hole is formed in the substrate, the hole allowing the lower-side diaphragm to protrude from the front surface of the substrate and penetrating in a thickness direction of the substrate.

In this configuration, light applied from the light emitting part passes through the irradiation path, to be reflected at the detection target, and then passes through the light receiving path, to be received at the light receiving part. In traveling of this light, when the diaphragm unit is formed at the irradiation path, the diaphragm unit narrows light applied from the light emitting part to a desired irradiated range and suppress irradiation of a range other than the desired range with light regardless of a position of the light emitting part. On the other hand, when a diaphragm unit is formed at the light receiving path, the diaphragm unit allows the light receiving part to receive light in a predetermined detected range in the reflected light, and suppresses entering of light from a range other than the desired range. In such a manner, the diaphragm unit suppresses variations in detection accuracy.

This diaphragm unit is separated into two portions, and also disposed on the upper case provided on the front surface of the substrate and on the lower case provided on the rear surface of the substrate. That is, the diaphragm unit lower portion constituting the lower side portion of the diaphragm unit is arranged in the lower case provided on the rear surface of the substrate, and protrudes from the rear surface to the front surface of the substrate through the through hole, and molding is thus possible even when a required amount of protrusion from the front surface of the substrate is extremely small.

In accordance with another aspect of the present invention, there is provided an image forming apparatus mounted with the toner density sensor.

According to the present invention, with the configuration as described above where the diaphragm unit lower portion constituting the lower-side portion of the useful diaphragm unit is provided in the lower case and protruded from the rear surface to the front surface of the substrate, it is possible to mold the diaphragm unit lower portion even when a required amount of protrusion from the front surface of the substrate is extremely small. For this reason, even when the light emitting part and the light receiving part are reduced in size and a center position of the diaphragm unit gets closer to the front surface of the substrate, it is possible to reliably obtain the diaphragm unit that narrow the light path.

It is therefore possible to suppress variations in detection accuracy due to provision of the diaphragm unit, and further to realize size reduction of the toner density sensor by means of size reduction of the light emitting part and the light receiving part.

DETAILED DESCRIPTION

Hereinafter, preferred embodiments of the present invention will be described with reference to the drawings.

Figure 1:
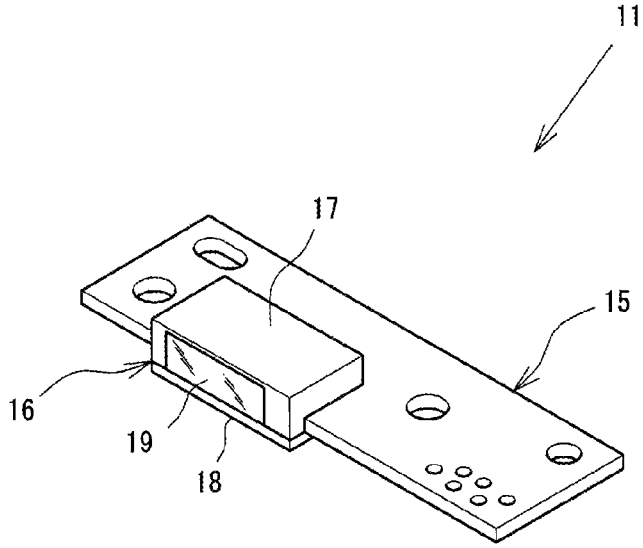
FIG. 1 is a perspective view of a toner density sensor.
Figure 2:
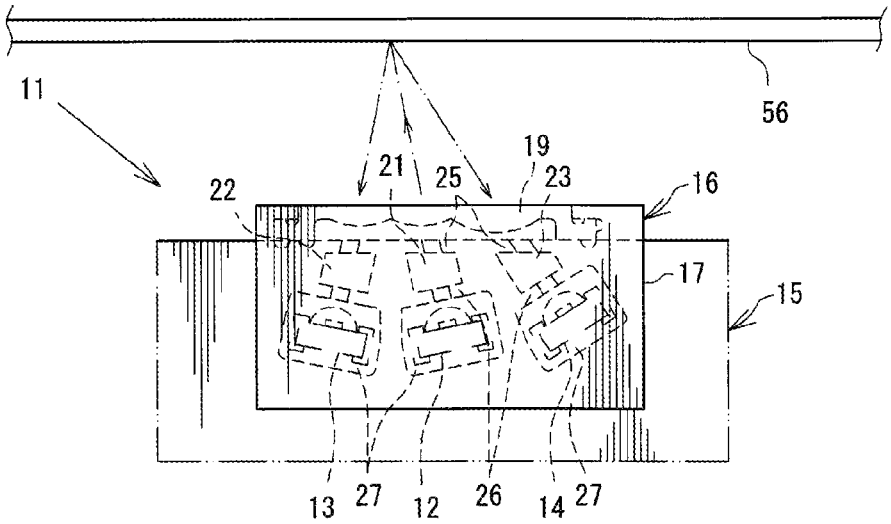
FIG. 2 is a front view schematically explaining the toner density sensor.

FIG. 1 is a perspective view of a toner density sensor 11, and FIG. 2 is a front view schematically explaining the toner density sensor 11.

Figure 3:
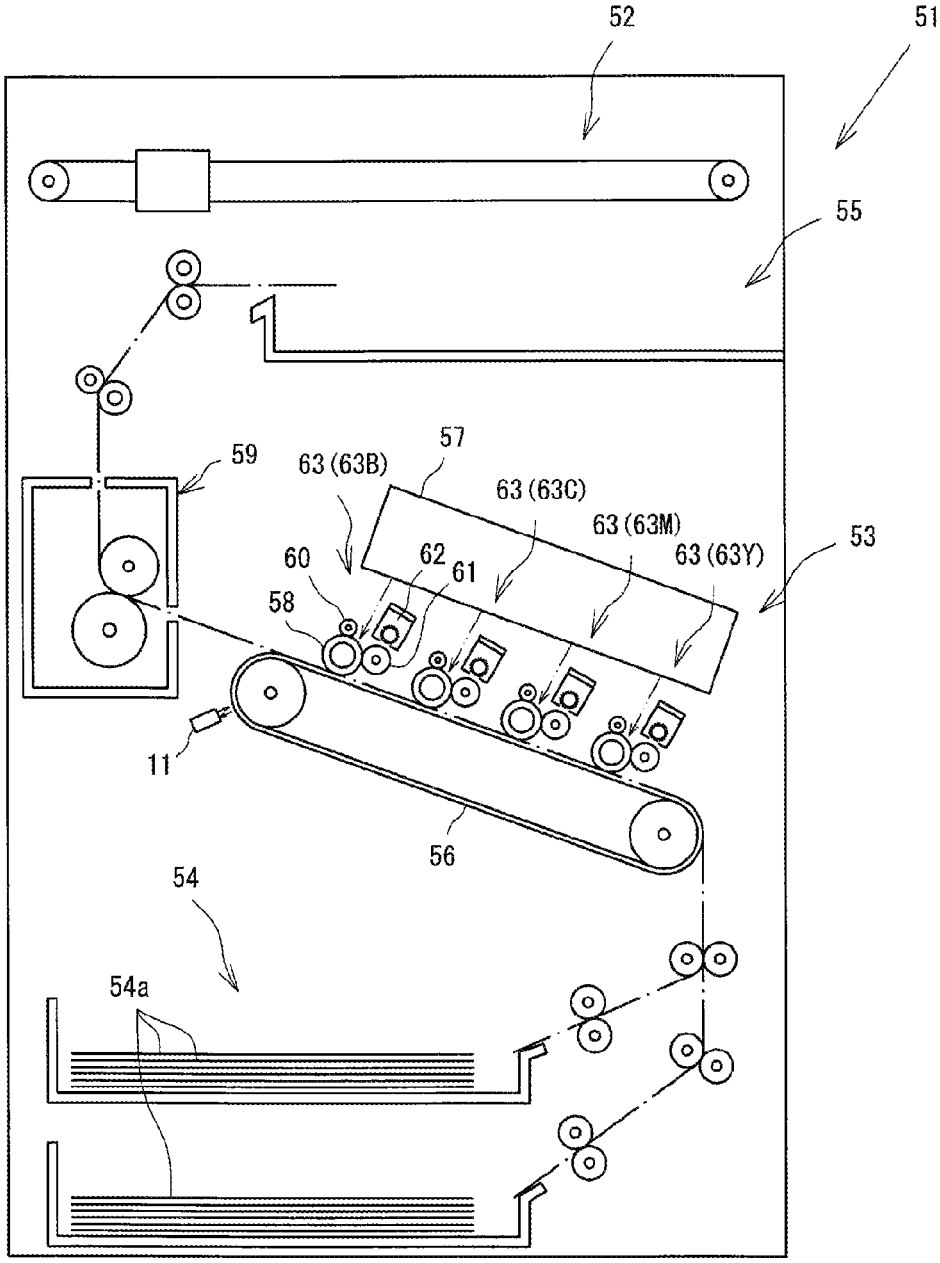
FIG. 3 is a schematic configuration diagram of an image forming apparatus.

The toner density sensor 11 is mounted in an image forming apparatus 51 as shown in FIG. 3. The image forming apparatus 51 is, for example, a color laser printer or the like.

First, a schematic structure of the image forming apparatus 51 will be described as follows.

The image forming apparatus 51 is configured such that an original reading unit 52 is provided in an upper portion, an image is formed in an image forming unit 53 based on original data read with the original reading unit 52, the image is transferred to a paper sheet 54*a* fed from a sheet feeding unit 54 arranged at lower part, and the paper sheet is discharged from the sheet discharge unit 55 at upper part.

The image formation in the image forming unit 53 is performed by primarily transferring toner to a tensioned transfer belt 56. That is, in the image forming unit 53, light is exposed from a light writing device 57 to the photosensitive drum 58, to which toner is made to adhere, and this toner having adhered to the photosensitive drum 58 is primarily transferred to the transfer belt 56. When the paper sheet 54*a* is fed onto the transfer belt 56 formed with the image as described above, the image is secondarily transferred from the transfer belt 56 to the paper sheet. The paper sheet 54*a* after being subjected to secondary transfer is conveyed to a fixing unit 59. The fixing unit 59 fixes the toner to the paper sheet 54*a* by heat and pressure.

In the figure, numeral 60 denotes a charging roller, numeral 61 denotes a development sleeve, and numeral 62 denotes a toner case. In the image forming unit 63 provided with the above units and a photosensitive drum 58, four image forming units (yellow 63Y, magenta 63M, cyan 63C, black 63B) are provided, and these are sequentially disposed along the transfer belt 56.

The toner density sensor 11 is provided as opposed to the transfer belt 56 in the image forming apparatus 51, and detects a toner density on the transfer belt 56. The toner density sensor 11 may be provided in the image forming unit 63. In this case, the toner density sensor 11 detects a toner density on the photosensitive drum.

Next, the toner density sensor 11 will be described.

As shown in FIG. 2, the toner density sensor 11 has a light emitting element 12 as a light emitting part that emits light, light receiving elements 13 and 14 as light receiving part that receives reflected light having been applied from the light emitting element 12 and reflected at the transfer belt 56 as a detection target, and an amplification circuit (not shown) that amplifies detection voltages of the light receiving elements 13, 14. For example, a light emitting diode is used as the light emitting element 12, and a phototransistor, a photodiode or the like is used as the light receiving elements 13 and 14.

Any of these light emitting element 12 and light receiving elements 13, 14 is a so-called side-view type element, which is surface-mounted in a side-edge portion of a printed substrate 15.

Specifically, as shown by a broken line of FIG. 2, the one light emitting element 12 and the two light receiving elements 13, 14 are disposed substantially straight in the side-edge portion of a printed substrate 15 along the longitudinal direction thereof. As indicated by virtual lines, the one (located on the left side in FIG. 2) of the two light receiving elements 13, 14 is the first light receiving element 13 that receives regularly reflected light in the reflected light having been applied from the light emitting element 12 and reflected, and it mainly detects a density of black toner. The other (located on the right side in FIG. 2) of the two light receiving elements 13, 14 is the second light receiving element 14 that receives diffusely reflected light in the reflected light having been applied from the light emitting element 12 and reflected, and it mainly detects densities of yellow, magenta and cyan color toner.

A portion mounted with the light emitting element 12 and the light receiving elements 13, 14 is covered by a black case 16 having light blocking properties. This case 16 is a synthetic resin molded article, and as shown in FIGS. 1 and 4A to 4D, the case 16 has an upper case 17 that covers the front surface of the printed substrate 15 as a side where the light emitting element 12 and the light receiving elements 13, 14 are mounted, and a lower case 18 that covers the rear surface of the printed substrate 15, and also holds a lens member 19 in a portion opposed to the end of the printed substrate 15. By fitting the upper case 17 with the lower case 18 so as to hold a predetermined position of the printed substrate 15 therebetween, a fit unit (not shown) is provided in which the cases are fitted with each other.

On the front surface of the printed substrate 15 covered by the case 16, there are provided light paths along the front surface of the printed substrate 15, the light paths having an irradiation path 21 that allows passage of light applied from the light emitting element 12 and light receiving paths 22, 23 that allow passage of the reflected light. The irradiation path 21 and the light receiving paths 22, 23 have diaphragm units 25, 26 that partially narrow the light path. These diaphragm units 25, 26 have light blocking properties as do the inner wall surfaces of the irradiation path 21 and the light receiving paths 22, 23, and the positions and sizes thereof are set such that an irradiated range in a desired direction is irradiated with light or reflected light is introduced from a detected range in a desired direction.

It is to be noted that the light path is a portion under light, and a portion other than the irradiation path 21 and the light receiving paths 22, 23 also constitutes part of the light path.

Further, although the diaphragm units 25, 26 are formed at all of the irradiation path 21 and the light receiving paths 22, 23 in the illustrative example, for example, they may be formed at the irradiation path 21 and the light receiving path 23 having the second light receiving element 14, or at only any one of the irradiation path 21 and the light receiving paths 22, 23.

In order to suppress variations in detection accuracy in a better manner, this toner density sensor 11 has adopted a configuration where a plurality of diaphragm units 25, 26 are formed with an interval therebetween along the longitudinal direction of the irradiation path 21 and the light receiving paths 22, 23, and the diaphragms unit 26 closest to the light emitting element 12 and the light receiving element 13 and 14 respectively are formed in the vicinity of the light emitting element 12 or the light receiving element 13 or 14.

The toner density sensor 11 shown in FIGS. 2 and 4A to 4D has the diaphragm units 25, 26 that narrow the light path at both ends of the irradiation path 21 or the light receiving path 22 or 23 which extends from a portion corresponding to the end of the printed substrate 15 to a housing space 27 that houses the light emitting element 12 or the light receiving element 13 or 14. These diaphragm units 25, 26 are each made up of a partition-like wall unit 28 protruding toward the inner side so as to block the light path, and a hollow 29 surrounded by this wall unit 28. The thickness of the wall unit 28 and the position and the size of the hole 29 are designed such that the desired irradiated range is irradiated with light, or reflected light is introduced from the desired detected range, as described above. The holes 29 of the two diaphragm units 25, 26, arrayed in the longitudinal direction of each of the light emitting element 12 and the light receiving elements 13, 14 have the same sizes. They can be made different sizes as required.

In the diaphragm units 25, 26 of the irradiation path 21, the diaphragm unit 26 in the vicinity of the light emitting element 12 is one to first block an unnecessary portion of irradiated light applied from the light emitting element 12, and the diaphragm unit 25 located at the end of the printed substrate 15 is one to block an unnecessary portion of the irradiated light which could not be blocked by the diaphragm unit 26 in the vicinity of the light emitting element 12.

In the diaphragm units 25, 26 of the light receiving paths 22, 23, the diaphragm unit 25 located at the end of the printed substrate 15 is one to first block an unnecessary portion of reflected light, and the diaphragm unit 26 in the vicinity of the light receiving element 13 or 14 is one to block an unnecessary portion of the reflected light which could not be blocked by the diaphragm unit 25 located at the end of the printed substrate 15.

Figure 4A:
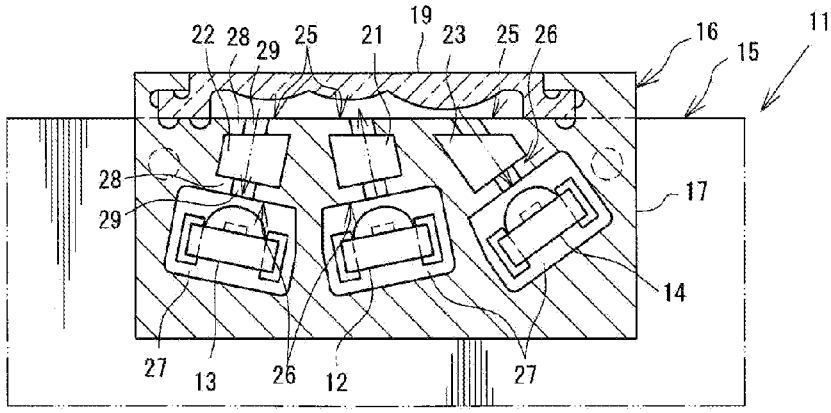
FIGS. 4A to 4D are a transverse sectional view and longitudinal sectional views showing a structure of the toner density sensor.
Figure 4B:
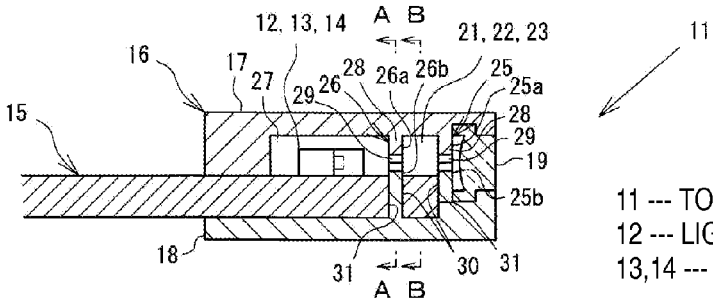

Further, in order to achieve the object of suppressing variations in detection accuracy and also dealing with size reduction, as shown in FIG. 4B, the toner density sensor 11 has adopted a configuration such that, as shown in FIG. 4B, diaphragm unit upper portions 25*a*, 26*a*, obtained by vertically separating the diaphragm units 25, 26 into two portions, are provided in the upper case 17, protrusions 30 formed at the upper end thereof with diaphragm unit lower portions 25*b*, 26*b*, obtained by vertically separating the diaphragm units into two portions, are provided in the lower case 18, and through holes 31 are formed in the substrate 15, the holes allowing the diaphragm unit lower portions 25*b*, 26*b* to protrude from the front surface of the substrate 15 and penetrating the substrate in the thickness direction.

Figure 4C:
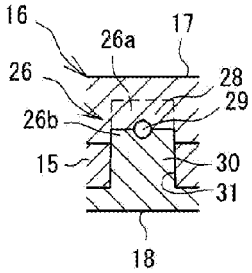
Figure 4D:
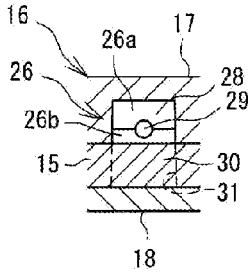

FIG. 4B is a sectional view showing a schematic structure in a state vertically cut at the center in the longitudinal direction of the irradiation path 21 or the light receiving path 22 or 23. FIG. 4C is an A-A sectional view of FIG. 4B, and FIG. 4D is a B-B sectional view of FIG. 4B.

As shown in these figures, on the inner surface of the upper case 17, other than the housing space 27 and the irradiation path 21 or the light receiving path 22 or 23, the diaphragm unit upper portions 25*a*, 26*a* as parts of the diaphragm units 25, 26 are formed. The diaphragm unit upper portions 25*a*, 26*a* have shapes of the upper side portions at the time of vertical division of the wall unit 28 with the center of the hole 29 as a boundary, and suspended from the ceiling surface of the irradiation path 21 or the light receiving path 22 or 23.

Meanwhile, the diaphragm unit lower portions 25*b*, 26*b* as parts of the diaphragm units 25, 26 are formed in the lower case 18. The diaphragm unit lower portions 25*b*, 26*b* have shapes of the lower side portions at the time of vertical division of the wall unit 28 with the center of the hole 29 as the boundary, and the upper edges of the diaphragm unit lower portions 25*b*, 26*b* are formed so as to abut on the lower edges of the diaphragm unit upper portions 25*a*, 26*a*.

Since the diaphragm unit lower portions 25*b*, 26*b* are ones to protrude from the rear surface to the front surface of the printed substrate 15 as described above, the diaphragm unit lower portions 25*b*, 26*b* are integrally provided at the upper ends of the protrusions 30 that have heights as large as the thickness of the printed substrate 15. The protrusions 30 are erected in portions of the upper surface of the lower case 18 which correspond to the diaphragm unit upper portions 25*a*, 26*a* of the upper case 17.

The through holes 31 to be fitted with and correspond to the lower protrusions 30 under the diaphragm unit lower portions 25*b*, 26*b* are formed in portions of the printed substrate 15 which correspond to the diaphragm unit lower portions 25*b*, 26*b*. The through hole 31 to be fitted with the protrusion 30 supporting the diaphragm unit lower portion 25*b* located at the end of the printed substrate 15 has a notched shape where a portion corresponding to the end of the printed substrate 15 is opened, and the through hole 31 to be fitted with the protrusion 30 supporting the diaphragm unit lower portion 26*b* in the vicinity of the light emitting element 12 or the light receiving element 13 or 14 has a hole-like shape with its periphery closed.

In the toner density sensor as thus configured, light from the light emitting element 12 passes through the irradiation path 21 and applied toward the transfer belt 56, and as shown in FIG. 4A, reflected light reflected at the transfer belt 56 passes through two light receiving paths 22, 23 and is received at the respective light receiving elements 13, 14. When light passes through the irradiation path 21 or the light receiving paths 22, 23, the diaphragm units 25, 26 regulate the range of applied light, or regulate the detected range of received light.

Figure 5:
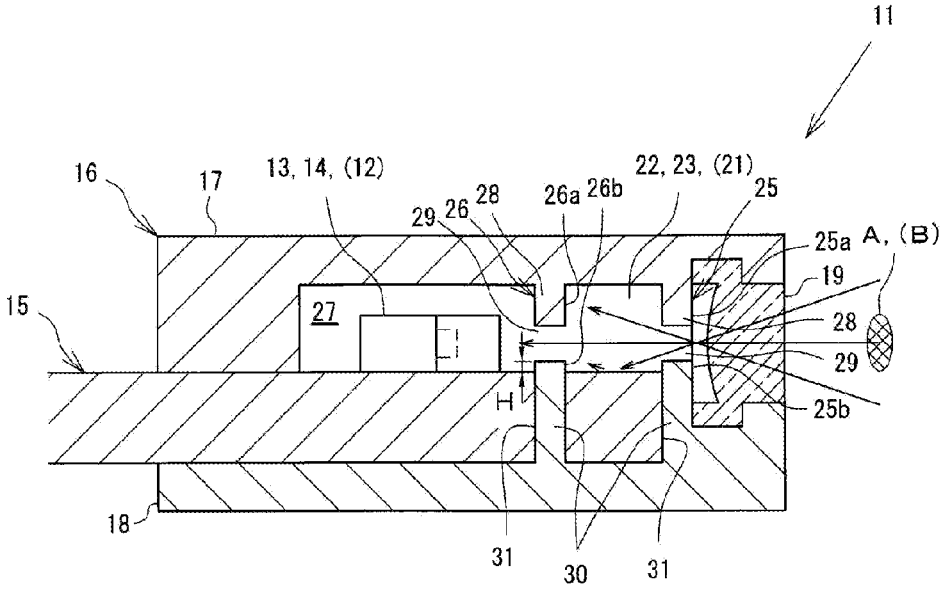
FIG. 5 is an explanatory view of an acting state of the toner density sensor.

That is, when it is described by taking the time of receiving light as an example, as indicated by an arrow in FIG. 5, reflected light from a detected range A to the diaphragm units 25, 26 enters straight toward the light receiving elements 13, 14, to be detected at the light receiving elements 13, 14. On the other hand, reflected light in a range out of the detected range A is blocked by the first diaphragm unit 25, namely the diaphragm unit 25 at the end of the printed substrate 15. Further, reflected light in a range out of the detected range A in the reflected light having passed through the first diaphragm unit 25 is reflected inside the light receiving paths 22, 23 and blocked by the back diaphragm unit 26.

The diaphragm units 25, 26 in the irradiation path 21 act in a similar manner, and perform regulation so as not to apply light to a range out of an irradiated range B.

As described above, since the irradiated range B with light and the detected range A of received light are appropriately adjusted by the diaphragm units 25, 26 in the case 16 fixed to the printed substrate 15, even when mounted positions of the light emitting element 12 and the light receiving elements 13, 14 are displaced from predetermined positions, it is possible to suppress variations in irradiated range B and detected range A regardless of the displacement. For this reason, it is possible to obtain uniform detection accuracy which is not affected by the mounted positions of the light emitting element 12 and the light receiving elements 13, 14.

Furthermore, with the plurality of diaphragm units 25, 26 provided, the effect of blocking excess light by the diaphragm units 25, 26 is sufficiently obtained as compared with the conventional toner density sensor (toner density sensor described in Unexamined Japanese Patent Publication No. 2005-91252) provided with the diaphragm units 25, 26 only in the vicinity of the element, so as to more favorably eliminate variations in detection accuracy.

Moreover, despite the fact that the diaphragm units 25, 26 that achieve the effect as thus described are formed on the front surface side of the printed substrate 15, the units are configured by going to all the trouble to make part thereof shared by the lower case 18 provided on the rear surface of the printed substrate 15. With such a configuration, no matter how smaller a height H of the diaphragm unit lower portions 25*b*, 26*b* as the lower-side portion is than the hole 29 of the diaphragm units 25, 26, the diaphragm unit lower portions 25*b*, 26*b* can be molded to exist on the front surface of the printed substrate 15.

For this reason, even when size reduction in light emitting element 12 and light receiving elements 13, 14 is performed, and the positions to be formed with the diaphragm units 25, 26 become closer to the front surface of the printed substrate 15, it is possible to reliably obtain such diaphragm units 25, 26. That is, as described above, it is possible to realize size reduction while favorably suppressing variations in detection accuracy.

Furthermore, the diaphragm unit lower portions 25*b*, 26*b* are provided in a state where the protrusions 30 integrally provided with the diaphragm unit lower portions 25*b*, 26*b* are penetrated through the printed substrate 15, thereby forming a firm structure free from damage by vibrations and the like.

Hereinafter, the other examples will be described. In this description, the same or similar portion as or to the foregoing configuration will be provided with the same numeral, and its detailed description will be omitted.

Figure 6A:
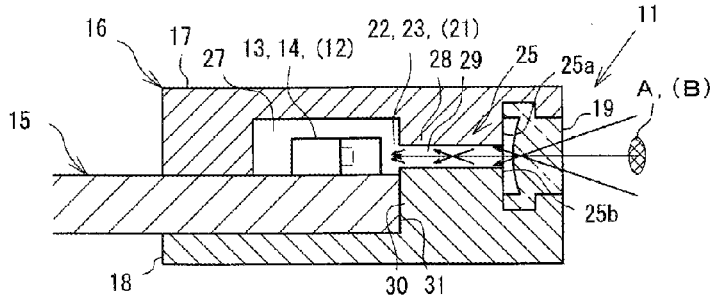
FIGS. 6A to 6D are longitudinal sectional views of a toner density sensor according to another example.

FIG. 6A shows an example where the diaphragm unit 25 is continuously formed along the longitudinal direction of the irradiation path 21 and the light receiving paths 22, 23, and the end of the diaphragm unit 25 on the light emitting element 12 or the light receiving element 13 or 14 side is formed in the vicinity of the light emitting element 12 or the light receiving element 13 or 14. In this example, the diaphragm unit 25 is formed over the longitudinal direction of the light receiving paths 22, 23 and the irradiation path 21 from a position corresponding to the end of the printed substrate 15 to the housing space 27.

In the toner density sensor 11 as thus configured, reflected light that enters from the outside of the detected range A is reflected at the inner surface of the diaphragm unit 25 of the light receiving paths 22, 23, but attenuates due to repeated reflection, and hence it is possible to prevent such reflected light from affecting detection performed by the light receiving elements 13, 14. Since a higher effect can be obtained by a larger number of times of reflection, the diaphragm unit 25 is desirably formed long.

Even with the irradiation path 21, a similar action as above can be obtained.

Figure 6B:
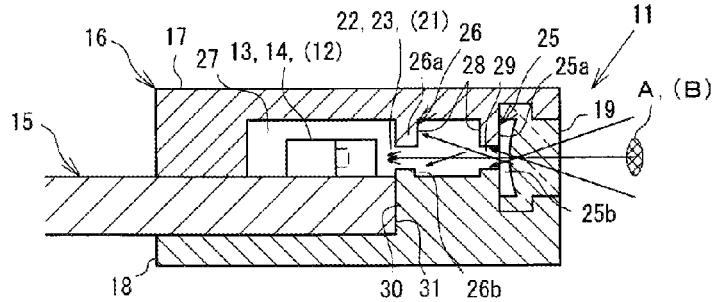

FIG. 6B shows an example where the diaphragm unit lower portions 25*b*, 26*b* of the diaphragm units 25, 26 formed at both ends of each of the light receiving paths 22, 23 and the irradiation path 21 in the longitudinal direction, as shown in FIG. 4B, are integrally formed. That is, the protrusion 30 formed in the lower case 18 is formed to have the same length as those of the light receiving paths 22, 23 and the irradiation path 21, and the diaphragm unit lower portions 25*b*, 26*b* are integrally provided at both ends of the upper end of the protrusion.

The toner density sensor 11 as thus configured has such an advantage as to be easy to manufacture since the protrusion 30 can be formed to be large even when size reduction is performed.

Figure 6C:
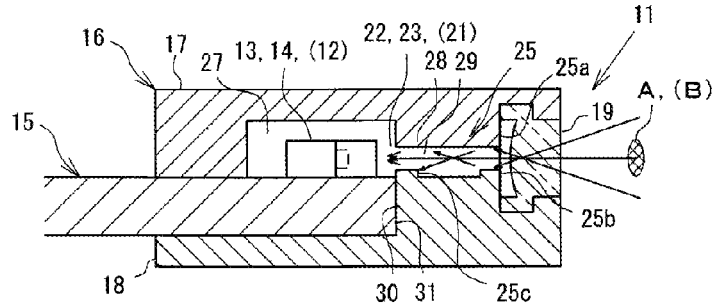
Figure 6D:
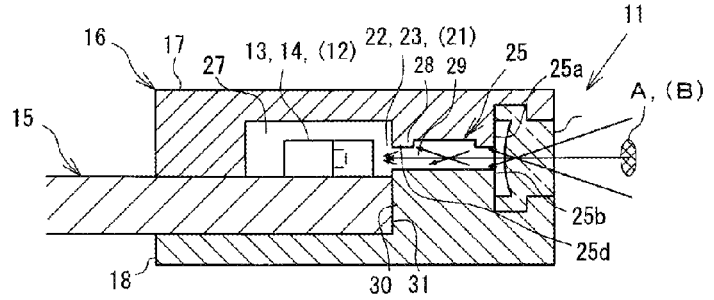

FIGS. 6C and 6D show examples of a combination of plural formation with an interval therebetween along the longitudinal direction of the irradiation path 21 and the light receiving paths 22, 23 and continuous formation in the longitudinal direction. That is, the diaphragm unit 25 shown in FIG. 6C is an example where the diaphragm unit upper portion 25*a* is formed in a continuous shape over the longitudinal direction of the irradiation path 21 or the light receiving path 22 or 23, and the diaphragm unit lower portions 25*b*, 25*c* are formed at both ends in the longitudinal direction of the irradiation path 21 or the light receiving path 22 or 23. FIG. 6D shows an example where the diaphragm unit 25 of FIG. 6C is configured upside down. In FIG. 6D, numeral 25*d* denotes a diaphragm unit upper portion.

Also in the toner density sensor 11 as thus configured, similarly to the above, it is possible to regulate the detected range A and the irradiated range B.

Figure 7:
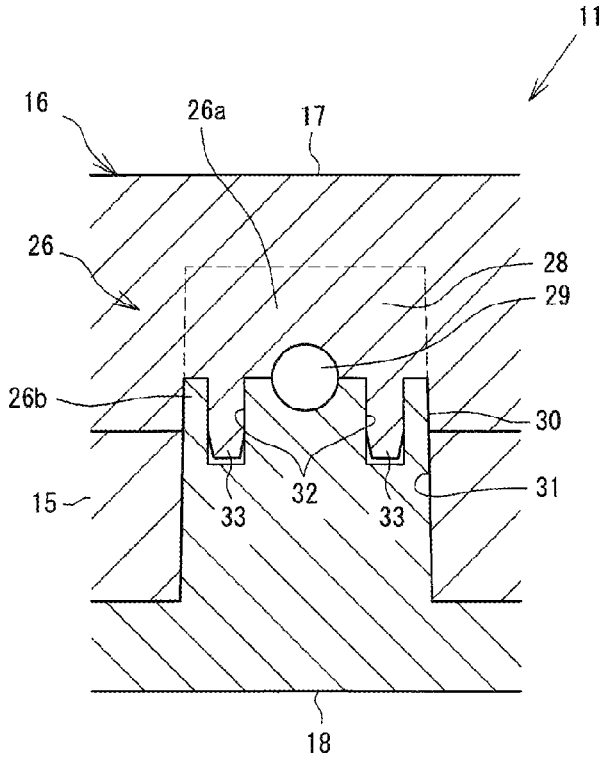
FIG. 7 is a longitudinal sectional view of a toner density sensor according to another example.
Figure 8:
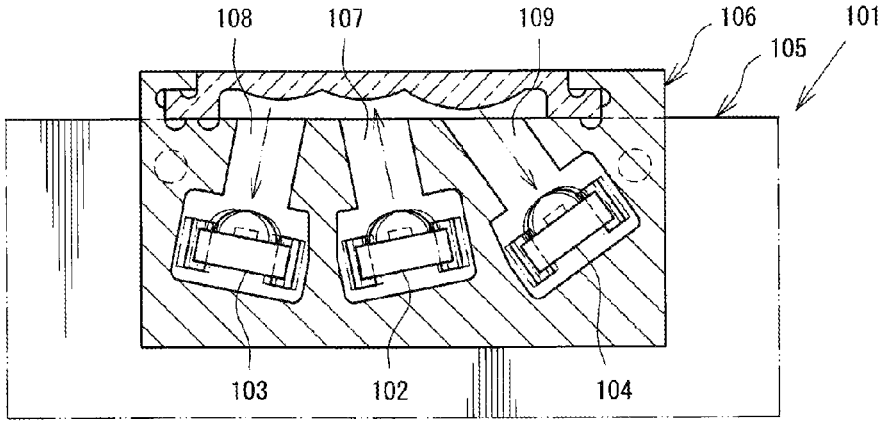
FIG. 8 is a transverse sectional view of a conventional toner density sensor.
Figure 9A:
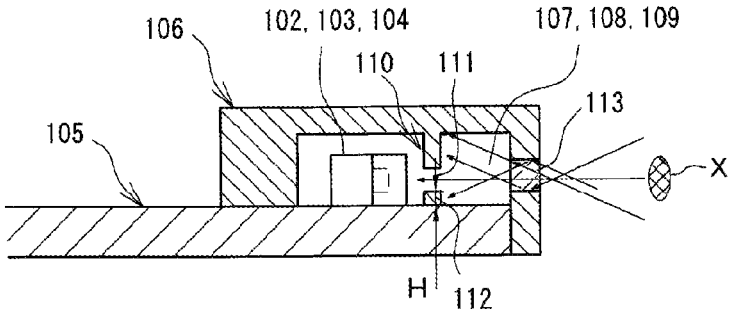
FIGS. 9A and 9B are a longitudinal sectional view and an explanatory view showing a problematic point of the conventional toner density sensor.
Figure 9B:
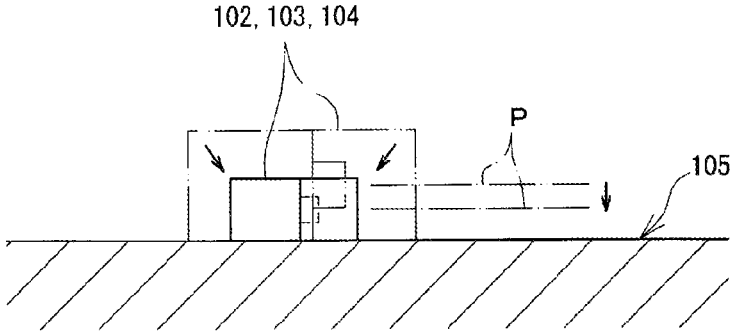

FIG. 7 shows an example where, in the diaphragm unit upper portion 26*a* and the diaphragm unit lower portion 26*b* that constitute the diaphragm unit 26, a fit structure is formed in which these units are fitted with each other. A similar configuration thereto can be formed in both the case where a plurality of diaphragm units 26 are provided as shown in FIG. 4 and the like and the case where a single diaphragm unit 26 is provided as shown in FIG. 6A.

FIG. 7 is a longitudinal sectional view of the diaphragm unit 26 portion, and as shown in this figure, fit holes 32 for fitting are formed in the upper surface of the diaphragm unit lower portion 26*b*, while fit protrusions 33 to be fitted into the fit holes 32 are formed in the lower surface of the diaphragm unit upper portion 26*a*.

In the toner density sensor 11 as thus configured, the fit holes 32 and the fit protrusions 33 are fitted with each other also in the diaphragm unit 26. Accordingly, even in the case of the diaphragm unit 26 with a vertically divided structure, the diaphragm unit 26 having a desired shape can be obtained. Furthermore, since holding the fit state allows the upper case 17 and the lower case 18 to be held in the fixed state to the printed substrate 15, when the fit holes 32 and the fit protrusions 33 are ones having individual fit strength, the other structure for holding the fit state of the upper case 17 and the lower case 18 can be omitted or simplified.

In a correspondence between the configuration of the present invention and the configuration of the foregoing one embodiment, the light emitting part of the present invention corresponds to the light emitting element 12;

and similarly to this, light receiving part corresponds to the light receiving elements 13, 14;

the detection target corresponds to the transfer belt 56;

the substrate corresponds to the printed substrate 15; and the fit structure corresponds to the fit hole 32 and the fit protrusion 33.

However, the present invention is not restricted to the foregoing configuration, and another configuration can also be adopted.

For example, the shape of the diaphragm unit upper portion and the diaphragm unit lower portion is not restricted to the shape vertically divided with the central position of the hole unit as the boundary, but it may be a vertically intricate shape.

What is claimed is:

1. A toner density sensor, comprising:

a light emitting part that emits light in order to detect a toner density;

a light receiving part that receives reflected light having been applied from the light emitting part and reflected at a detection target;

a light path formed along the front surface of a substrate on which the light emitting part and the light receiving part are surface-mounted, the light path having an irradiation path that allows passage of light emitted from the light emitting part and a light receiving path that allows passage of the reflected light; and a diaphragm unit that is formed at the light path and partially narrows the light path, wherein an upper case that covers the light emitting part and the light receiving part, and forms the light path and a diaphragm unit upper portion, is provided on the front surface of the substrate, the diaphragm unit upper portion being one of upper and lower portions of the diaphragm unit, a lower case that is coupled with the upper case to hold the substrate therebetween is provided on the rear surface of the substrate, a protrusion part with its top end provided with a diaphragm unit lower portion is formed in the lower case, the diaphragm unit lower portion being one of upper and lower portions of the diaphragm unit, and a through hole is formed in the substrate, the hole allowing the diaphragm unit lower portion to protrude from the front surface of the substrate and penetrating in a thickness direction of the substrate.

2. The toner density sensor according to claim 1, wherein a plurality of diaphragm units are formed with an interval therebetween along a longitudinal direction of at least one of the irradiation path and the light receiving path, and the diaphragm units closest to the light emitting part and the light receiving part respectively are formed in the vicinity of the light emitting part or the light receiving part.

3. An image forming apparatus on which the toner density sensor according to claim 2 is mounted.

4. The toner density sensor according to claim 2, wherein in the diaphragm unit upper portion and the diaphragm unit lower portion, a fit structure is formed in which the diaphragm unit upper portion and the diaphragm unit lower portion are fitted with each other.

5. An image forming apparatus on which the toner density sensor according to claim 4 is mounted.

6. The toner density sensor according to claim 1, wherein the diaphragm unit is continuously formed along a longitudinal direction of at least one of the irradiation path and the light receiving path, and an end of the diaphragm unit on the light emitting part or the light receiving part side is formed in the vicinity of the light emitting part or the light receiving part.

7. An image forming apparatus on which the toner density sensor according to claim 6 is mounted.

8. The toner density sensor according to claim 6, wherein in the diaphragm unit upper portion and the diaphragm unit lower portion, a fit structure is formed in which the diaphragm unit upper portion and the diaphragm unit lower portion are fitted with each other.

9. An image forming apparatus on which the toner density sensor according to claim 8 is mounted.

10. The toner density sensor according to claim 1, wherein in the diaphragm unit upper portion and the diaphragm unit lower portion, a fit structure is formed in which the diaphragm unit upper portion and the diaphragm unit lower portion are fitted with each other.

11. An image forming apparatus on which the toner density sensor according to claim 10 is mounted.

12. An image forming apparatus on which the toner density sensor according to claim 1 is mounted.

* * * * *